US007567155B2

(12) United States Patent
Kwiatkowski et al.

(10) Patent No.: US 7,567,155 B2
(45) Date of Patent: Jul. 28, 2009

(54) CONFIGURABLE HIGH FREQUENCY COAXIAL SWITCH

(75) Inventors: Regina Kwiatkowski, Cambridge (CA); Mihai Vladimirescu, Cambridge (CA)

(73) Assignee: COM DEV International Ltd., Cambridge (CA)

( * ) Notice: Subject to any disclaimer, the term of this patent is extended or adjusted under 35 U.S.C. 154(b) by 198 days.

(21) Appl. No.: 11/832,228

(22) Filed: Aug. 1, 2007

(65) Prior Publication Data

US 2009/0033444 A1 Feb. 5, 2009

(51) Int. Cl.
*H01P 1/10* (2006.01)
*H01P 1/04* (2006.01)

(52) U.S. Cl. ..... 333/262; 333/105

(58) Field of Classification Search ..... 333/262, 333/101, 105, 4, 5
See application file for complete search history.

(56) References Cited

U.S. PATENT DOCUMENTS

| | | | | |
|---|---|---|---|---|
| 3,478,282 | A | 11/1969 | Smith | |
| 4,780,692 | A | 10/1988 | Kiedrowski | |
| 5,132,644 | A | 7/1992 | Knorr | |
| 5,434,548 | A | 7/1995 | Thompson et al. | |
| 6,043,440 | A * | 3/2000 | Sun et al. | 200/51.04 |
| 6,252,473 | B1 | 6/2001 | Ando | |
| 6,650,210 | B1 | 11/2003 | Raklyar et al. | |
| 6,856,212 | B2 | 2/2005 | Kwiatkowski et al. | |
| 6,870,454 | B1 | 3/2005 | Vladimirescu et al. | |
| 6,951,941 | B2 | 10/2005 | Kwiatkowski | |
| 2004/0113714 | A1 | 6/2004 | Kwiatkowski et al. | |
| 2004/0155725 | A1 | 8/2004 | Kwiatkowski | |
| 2005/0052265 | A1 | 3/2005 | Vladimirescu et al. | |
| 2006/0176124 | A1 | 8/2006 | Mansour et al. | |

FOREIGN PATENT DOCUMENTS

| | | |
|---|---|---|
| EP | 1 431 991 A2 | 6/2004 |
| EP | 1 445 819 A1 | 8/2004 |
| EP | 1 513 176 A2 | 3/2005 |
| JP | 56-076601 | 6/1981 |

OTHER PUBLICATIONS

Janusz A. Dobrowolski, Introduction to Computer Methods for Microwave Circuit Analysis and Design, Artech House Inc., ISBN 0-89006-505-5, 1991, pp. 28-30.
Peter A. Rizzi, Microwave Engineering Passive Circuits, Prentice Hall, 1988, pp. 42-45, 69-73.

* cited by examiner

*Primary Examiner*—Dean O Takaoka
(74) *Attorney, Agent, or Firm*—Bereskin & Parr LLP; Isis E. Caulder

(57) ABSTRACT

Various embodiments are provided herein for a configurable high frequency coaxial switch. The switch includes a switch housing module that has at least two ports and is adapted for operation in a wide frequency band. The switch also includes at least one frequency-matching port component module that is configured to connect a transmission line to one of the ports of the switch housing module. The at least one frequency-matching port component module is also configured to provide a match to a desired frequency range. In use, the switch housing module together with the at least one frequency-matching port component module allow for operation of the configurable high frequency coaxial switch at the desired frequency range.

19 Claims, 12 Drawing Sheets

CONFIGURABLE HIGH FREQUENCY COAXIAL SWITCH

FIELD

The embodiments described herein relate to high frequency coaxial switches, and in particular, to frequency-related configurable high frequency coaxial switches.

BACKGROUND

In modern satellite systems, and in other applications, there is a need for radio frequency coaxial switches that perform at ever-higher frequencies. In the prior art, the design strategy for a coaxial switch has been to match the RF paths in as wide a frequency band as possible, such that a few designs could cover all of the frequency bands of commercial interest. However, prior art switch designs have demonstrated poor performance at high frequencies, mostly due to high mismatch losses.

The performance parameters of a coaxial RF switch are the RF power handling, the return loss and isolation; insertion loss is usually an outcome of design features imposed to achieve the desired RF power handling, return loss and isolation. Most coaxial switches, at high operating frequencies, are low RF power devices and therefore the RF power handling is not an important design driver. Isolation is a function of the RF channels, and is relatively easily predicted. However, return loss is more difficult to model, particularly in switches having a complex geometry, and is therefore more difficult to improve in a wide band RF switch design.

The majority of prior art coaxial RF switches that are impedance-matched to a wide frequency band of RF signals do not perform well at frequencies in excess of 30 GHz.

In addition, even relatively good performance individual switches, in terms of reflection, when cascaded, as required by the switching systems used on communication satellites for example, end-up as low performance assemblies. For example a cascaded assembly of N switches each having X return loss (in dB) will have an overall Y return loss (in dB) given by:

$$Y=X+10\cdot\log_{10}N \tag{1}$$

Equation (1) shows that the overall reflection of the assembly will deteriorate by $10\cdot\log_{10}$ N dB, which in the case of 6 cascaded switches for example, means almost 8 dB. This deterioration in performance for the assemblies containing cascaded switches is pushing the requirements on each individual switch higher by at least the same amount.

The low performance of the prior art coaxial switches at higher frequencies is due to the fact that as the frequency increases the wavelength decreases and discontinuities that were transparent for lower frequencies become important, in terms of the reflected signal. Therefore as the frequency increases in a wide frequency band, in order to reduce reflection, one needs high precision parts and very accurate positioning of the moving conductors inside the RF channels of the switch. These requirements become more stringent in complex switch structures, for example T-switch structures, which impose some transmission line discontinuities by their very nature.

The required precision of the switch parts and/or their accurate positioning inside the RF channels of the switch can be reduced where a specific switch will only be used in a limited frequency band around the commercially required frequency and hence will be required to be well matched only in this narrow frequency band. The development of coaxial switches with very good reflection performance around all the required frequencies is however prohibitive for switch manufacturers due to the high cost of producing switch parts requiring high dimensional diversity.

SUMMARY

In one aspect, at least one embodiment described herein provides a configurable high frequency coaxial switch comprising a switch housing module having at least two ports, the switch housing module being adapted for operation in a wide frequency band; and, at least one frequency-matching port component module configured to connect a transmission line to one of the ports of the switch housing module. The at least one frequency-matching port component module is configured to provide a match to a desired frequency range. In use, the switch housing module together with the at least one frequency-matching port component module allow for operation of the configurable high frequency coaxial switch at the desired frequency range.

In another aspect, at least one embodiment described herein provides a frequency-matching connector module for use in a configurable high frequency coaxial switch adapted for operation in a wide frequency band. The frequency-matching connector module comprises a connector female portion for receiving a transmission line; and, a connector male portion, attached to the connector female portion, for engaging a port of the configurable high frequency coaxial switch. The connector male portion comprises a modular portion with a geometry configured to provide a match for the configurable high frequency coaxial switch to a desired frequency range.

In another aspect, at least one embodiment described herein provides a frequency-matching connector adapter module for use in a configurable high frequency coaxial switch adapted for operation in a wide frequency band. The frequency-matching connector adapter module comprises an adapter female portion for receiving a transmission line; an adapter male portion for engaging a standard connector for a port of the reconfigurable high frequency coaxial switch; and, an adapter frequency-matching portion, for connecting the adapter female portion to the adapter male portion and having a geometry that is configured to provide a match for the configurable high frequency coaxial switch to a desired frequency range.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1A:
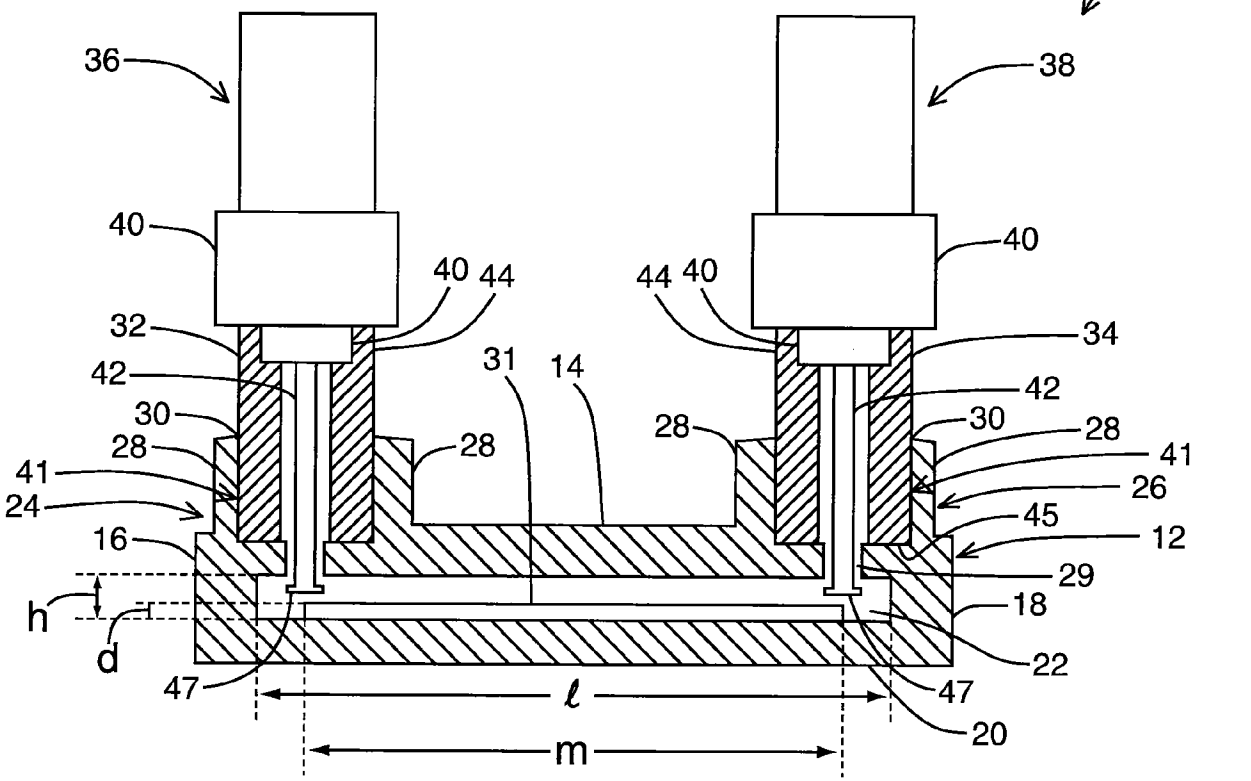
FIG. 1A PRIOR ART
FIG. 1A is a cross-sectional view of an exemplary single pole single throw high frequency coaxial switch of the prior art in an open position.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Figure 1B:
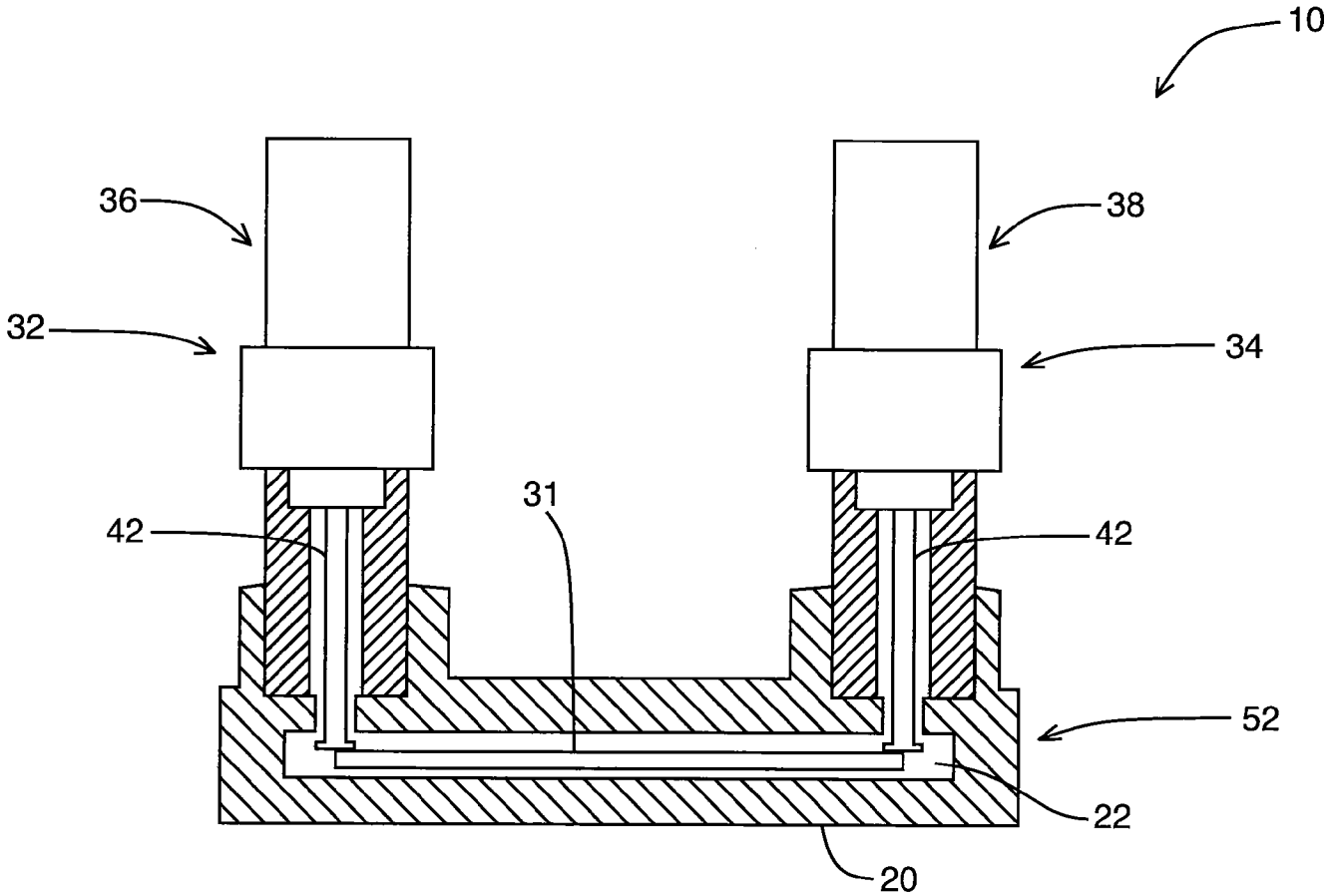
FIG. 1B PRIOR ART
FIG. 1B is a cross-sectional view of an exemplary single pole single throw high frequency coaxial switch of the prior art in a closed position.

Reference is first made to FIGS. 1A and 1B, which show a cross-sectional view of an exemplary single pole single throw high frequency coaxial switch 10 of the prior art. The switch 10 comprises a switch housing 12, having an upper wall 14, a first end wall 16, a second end wall 18, and a lower wall 20. The switch housing 12 defines a switch cavity 22, having a length, l, extending between the first end wall 16 and the second end wall 18 and a height, h, extending between the upper wall 14 and the lower wall 20.

The switch housing 12 further comprises a first port 24 and a second port 26, each of the first port 24 and second port 26 comprising a cylindrical port wall 28 and a port channel 30. The port channel 30 is in fluid connection with the switch cavity 22. The first port 24 is located on the upper wall 14 of the switch housing 12 in the vicinity of the first end wall 16. The second port 26 is located on the upper wall 14 of the switch housing 12 in the vicinity of the second end wall 18.

The switch cavity 22 houses a conductive reed 31 having a length, m that is shorter than the length, l, of the switch cavity 22. The RF reed 31 is a substantially rectangular blade, having a width, d. The conductive reed is positioned in the switch cavity 22 such that it does not contact the first end wall 16 or the second end wall 18. The conductive reed 31 is movable through a switch mechanism (not shown) from a first position parallel to and contacting the lower wall 20 to a second position parallel to the lower wall 20 and free of any contact with the switch housing 12.

The switch 10 further comprises a first connector 32 and a second connector 34, which engage the first port 24, and the second port 26, respectively. Each connector 32, 34 comprises a connector female portion 40 for receiving a male connector of a transmission line 36, 38, and a connector male portion 41 for engaging a port 24, 26. Each connector 32, 34 further comprises a hollow, open-ended cylindrical connector shell 44 and a connector probe 42. The connector shell 44 and the probe 42 are positioned relative to one another with plastic beads, or by other means known in the art, not shown for clarity of the illustration.

A protruding end 47 of the connector probe 42, distal from the connector female portion 40, protrudes from the open end of the connector shell 44 distal from the female portion 40. The connector shell 44 of each connector 32, 34 engages with the port wall 28 of each port 24, 26 and the protruding end 47 of the connector probe 42 of each connector 32, 34 extends through the port channel 30, and the entry 29, into the switch cavity 22, without contacting the port wall 28.

FIG. 1A illustrates an open switch path. In an open switch path, the conductive reed 31 lies parallel to and in contact with the lower wall 20, and does not contact either of the connector probes 42. As a result, the switch cavity 22 forms a rectangular waveguide isolating the path from the first transmission line 36 to the second transmission line 38. The excitation signals, with frequencies below the cut-off frequency of this rectangular waveguide, from the first transmission line 36 will not, therefore, be transmitted to the second transmission line 38, and vice versa. The position of the conductive reed 31 is controlled by the switch mechanism (not shown).

FIG. 1B illustrates a switch path in a closed position. In this case, the conductive reed 31 is positioned parallel to, but not in contact with, the lower wall 20. The conductive reed 31 contacts both of the connector probes 42, creating a coaxial transmission line between the probes 42 thereby providing a conductive path from the first transmission line 36 to the second transmission line 38. The dimensions and shape of the conductive reed 31 are such as to achieve a characteristic impedance that matches the transmission line when the reed 31 is in contact with the probes. As a result, a signal from the first transmission line 36 may be transmitted to the second transmission line 38, and vice versa, with minimal reflections. The position of the conductive reed 31 is controlled by the switch mechanism (not shown).

The switch cavity 22 is a rectangular waveguide designed such as to have a cut-off frequency that is much higher than the operating switch signal frequency, thereby ensuring good isolation between the connector ports 42 when the reed 31 is grounded.

For clarity, the description and FIGS. 1A and 1B illustrate a very simple switch structure: a single pole single throw switch. However, it will be understood by those skilled in the art that the principles of operation of the switch described above are not limited to a single pole single throw switch, but extend to all other high frequency coaxial switch types, including, but not limited to, single pole n-throw switches, transfer switches and cross-point switches (T-switches).

As described previously, a switch structure is designed for a particular application and a desired frequency range. Conventionally, the switch structure as a whole is designed to meet specified performance requirements for the desired frequency range, and the manufacturing process is then designed to produce this particular switch. Thereafter, when a new switch is required for a new application and a new desired frequency range, conventionally a new design is made for the new switch, as well as a corresponding design of the manufacturing process for manufacturing the new switch.

As described herein, a new switch design is provided which has modular components such that different switch products can be produced for different applications and different frequency ranges without requiring a redesign of the switch or the manufacturing process. Rather, modular components are used such that at least one of the modular components can be re-used for a variety of different products while other portions of the modular components are redesigned as needed for the particular application and desired frequency range as the case may be. This allows different switch products to be more efficiently manufactured since the entire switch does not have to be redesigned for a new application and desired frequency range.

For example, according to the teachings herein, a switch housing module can be made for operation in a wide frequency band. The switch housing module can then be configured so that it is operable in any desired frequency range, which can be inside or outside of (i.e. higher or lower than) the wide frequency band, for example, by using frequency matching component modules that can provide a match for the switch housing module to the desired frequency range. This holds for all of the following embodiments described herein. This allows for the mass production of the switch housing module along with the production of particular frequency matching components, as required, which are then combined with the switch housing module to manufacture a switch product for the particular application at the desired frequency range. This notion of modularity can also be extended to the manufacture of the frequency matching components themselves. These structures are described in further detail below. Accordingly, the use of these modular components optimizes the production of these switches, which are easily configurable depending on the particular application and desired operating frequency range.

Figure 2:
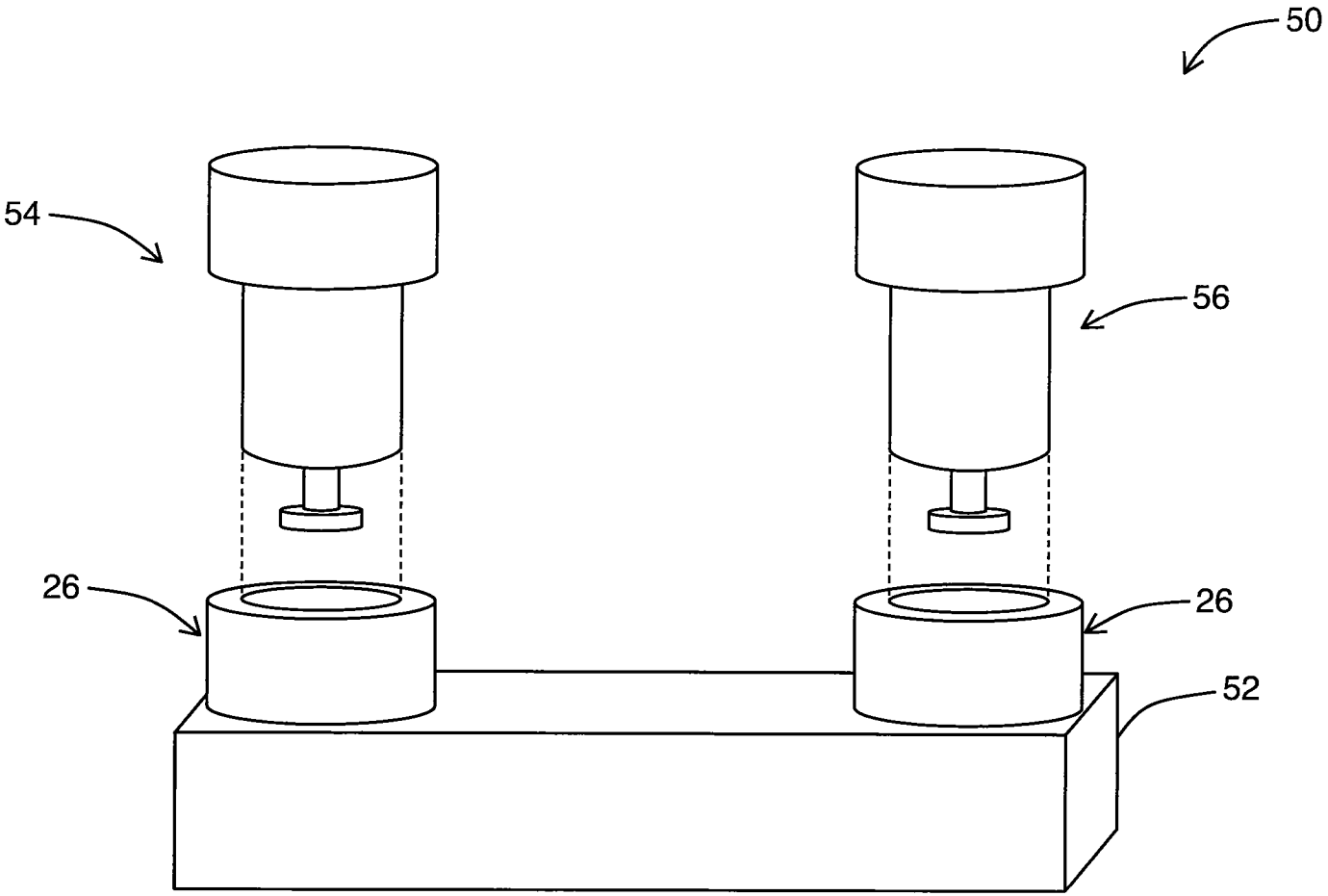
FIG. 2 is an exploded view of an exemplary embodiment of a configurable high frequency coaxial switch.

Reference is now made to FIG. 2, which shows an exploded view of an exemplary embodiment of a configurable high frequency coaxial switch 50 in accordance with the teachings provided herein. The configurable high frequency switch 50 comprises a switch housing module 52, a first frequency-matching port component module 54 and a second frequency-matching port component module 56, which engage the ports 26 of the switch housing module 52. The frequency-matching port component modules 54, 56 are removable from the ports 26 and are interchangeable with other frequency-matching port component modules to configure the switch 50 for operation at a desired frequency range. The switch housing module 52 generally has the same configuration as the switch housing 12 described above with respect to FIGS. 1A and 1B or any other analogous switch housing that provides operation in a wide frequency band. The first frequency-matching port component module 54 and the second frequency-matching port component module 56 may be either frequency-matching connector modules or frequency-matching connector adapter modules together with standard connectors, as described in further detail below.

The switch housing module 52, in the absence of the frequency-matching port component modules 54, is wideband and is matched to a wide range of signal frequencies, up to the higher mode propagation limit in the range of 22-26 GHz. The frequency-matching port component modules 54, 56 optimize the RF performance of the configurable high frequency coaxial switch 50 in a limited (for example, in the range of 2 GHz) high-frequency band around an operating frequency that may be significantly higher than, lower than or within the wide range of frequencies matched to the switch housing module 52 without the frequency-matching port component modules 54, 56. For example, the switch housing module 52 can be matched to a wide range of frequencies up to 26 GHz. With the addition of the frequency-matching port component modules 54, 56 the configurable high frequency switch 50 can be matched to perform in a limited high frequency range around 30 GHz, 40 GHz, or 50 GHz. Accordingly, the configurable high frequency switch module 50 can be configured to perform in a desired limited high frequency range by adding the frequency-matching component modules 54, 56 that are matched to the desired limited high frequency range to the switch housing module 52. This allows the switch housing module 52 to be re-used for a variety of different applications and frequency ranges by using a frequency-matching component module that can provide a match for operation at the intended or desired frequency range.

The exemplary configurable high frequency coaxial switch 50 of FIG. 2 is a single pole single throw switch. It will, however, be understood by those skilled in the art that this is for the purposes of illustration only. The configurable high frequency coaxial switch 50 described herein is not limited to a single pole single throw switch, but extends to all other high frequency coaxial switch types, including, but not limited to, single pole n-throw switches, transfer switches and cross-point switches (T-switches).

Figure 3:
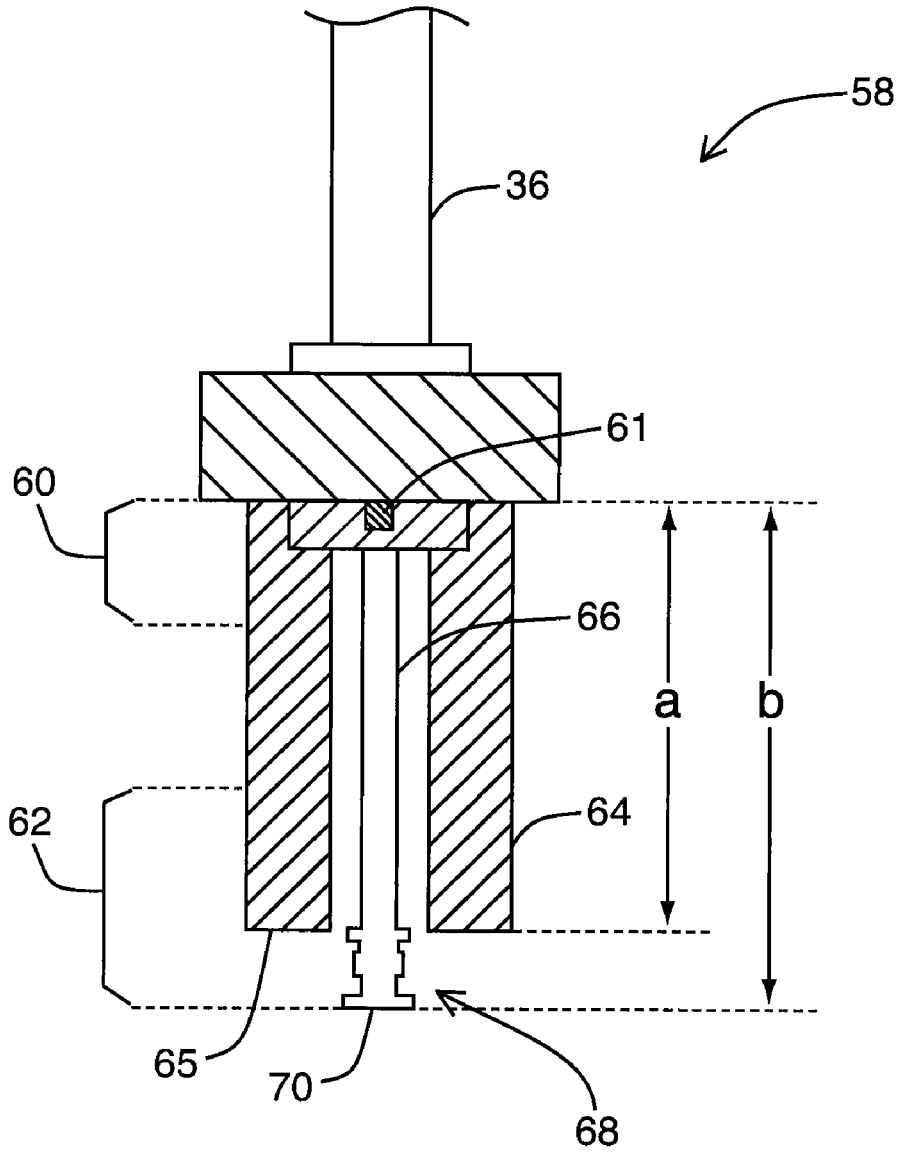
FIG. 3 is a cross-sectional view of an exemplary embodiment of a frequency-matching connector module of the configurable high frequency coaxial switch.

Reference is now made to FIG. 3, which shows a cross-sectional view of an exemplary frequency-matching connector module 58 of the configurable high frequency coaxial switch 50. The frequency-matching connector module 58 comprises a connector female portion 60 for receiving a male connector 61 of a transmission line 36, and a connector male portion 62 for removably engaging a port (not shown) of the switch housing module 52. The frequency-matching connector module 58 comprises a hollow open-ended cylindrical connector shell 64 of length a and a modular frequency-matching probe 66 of length b, where b is longer than a. The connector shell 64 and the modular frequency-matching probe 66 are positioned relative to one another with plastic beads, or by other means known in the art, not shown for clarity of the illustration.

The modular frequency-matching probe 66 has a protruding end, having a frequency-matching region 68 and a reed contact surface 70, distal from the female portion 60, that protrudes past the frequency-matching connector shell 64. The frequency-matching region 68 comprises sections with lengths and diameters calculated to achieve good impedance matching around the desired operating frequency for the cavity 22 of the switch housing module 52. Accordingly, the frequency matching connector module 58 is also modular in the sense that most of the components of the frequency matching connector module 58 can be standard components that are manufactured in bulk and the modular frequency-matching probe 66 can be manufactured according to the desired frequency range of operation thereby increasing the efficiency of the manufacturing process.

Figure 4A:
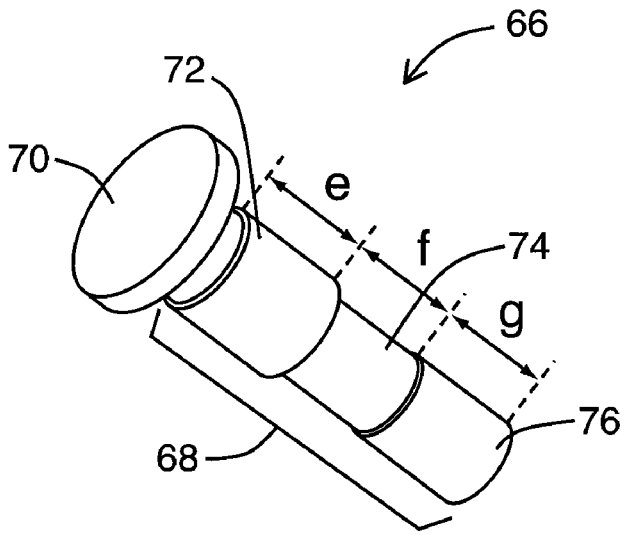
FIG. 4A is a perspective view of the frequency-matching region and the reed contact surface of the exemplary frequency-matching connector module of FIG. 3.
Figure 4B:
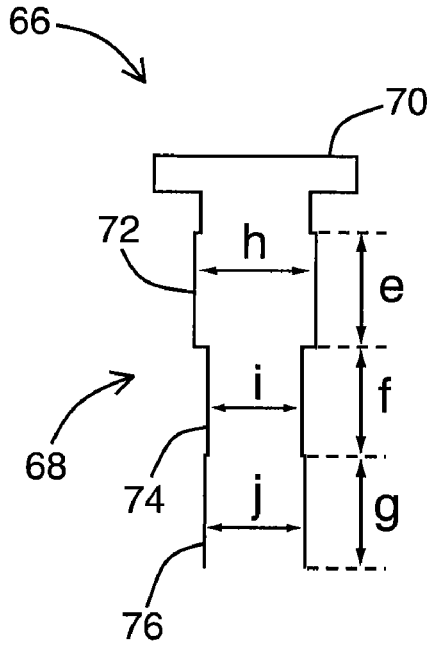
FIG. 4B is a cross-sectional view of the frequency-matching region and the reed contact surface of the exemplary frequency-matching connector module of FIG. 3.

FIGS. 4A and 4B show perspective and cross-sectional views, respectively, of the frequency-matching region 68 and the reed contact surface 70 of the replaceable frequency-matching connector module 58. When the replaceable frequency-matching connector 58 is engaged with a port 26 of the switch housing module 52, the reed contact surface 70 is located inside the switch cavity 22, parallel to, and facing, the lower surface 20 of the switch housing module 52. The reed contact surface 70 provides the contact point for the reed 31 when the configurable high frequency coaxial switch 50 is in the closed position.

The frequency-matching region 68 of the frequency-matching connector module 58 of FIGS. 4A and 4B comprises three consecutive matching probe segments: a first matching segment 72, a second matching segment 74 and a third matching segment 76. Each of the first matching segment 72, second matching segment 74, and third matching segment 76 has a length, e, v, and g, respectively, and a diameter h, i, and w, respectively. The number of matching segments, the lengths e, v, and g, and the diameters, h, i, and w, of the first matching segment 72, second matching segment 74 and third matching segment 76 determine the range of frequencies for which the RF performance of the configurable high frequency coaxial switch 50 may be optimized with the frequency-matching connector module 58. The dimensions may be determined by any method known in the art.

It will be understood by those skilled in the art that a variety of similar frequency-matching probes, having different numbers of matching segments, diameters of matching segments, and lengths of matching segments are comprised in various embodiments of the frequency-matching probe. The dimensions and shape of each frequency-matching probe are selected to optimize the performance of the configurable high frequency coaxial switch 50 in a desired limited bandwidth around the required operating frequency (i.e. desired frequency range).

Figure 5:
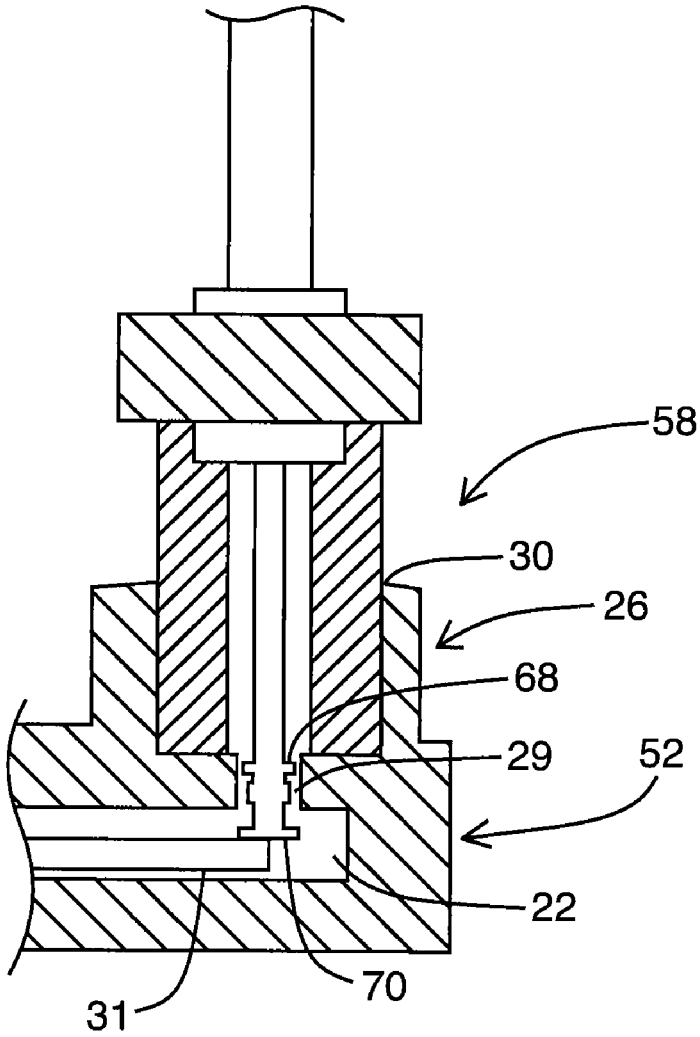
FIG. 5 is a cross-sectional view of the exemplary frequency-matching connector module of FIG. 3 engaged with a port of a configurable switch housing.

Reference is now made to FIG. 5, which is a cross-sectional view of an exemplary frequency-matching connector module 58 engaged with a port 26 of the switch housing module 52, where the switch housing module 52 is modular in nature as explained previously. The frequency-matching connector module 58 is engaged with the port channel 30 such that the reed contact surface 70 contacts the reed 31 when the configurable high frequency coaxial switch 50 is in a closed position. The frequency-matching region 68 of the frequency-matching connector module 58 is located in the entry 29 to the cavity 22 of the switch housing module 52.

A signal with frequency components in the limited range surrounding the desired operating frequency that is optimized by the frequency-matching connector module 58 can be transmitted through the closed configurable high frequency coaxial switch 50 with minimal loss. If a different high frequency operating frequency is required in an application of the device, then a different frequency-matching connector module 58 can be installed within the port 26 of the switch housing module 52 which is matched to the different high operating frequency.

Figure 6:
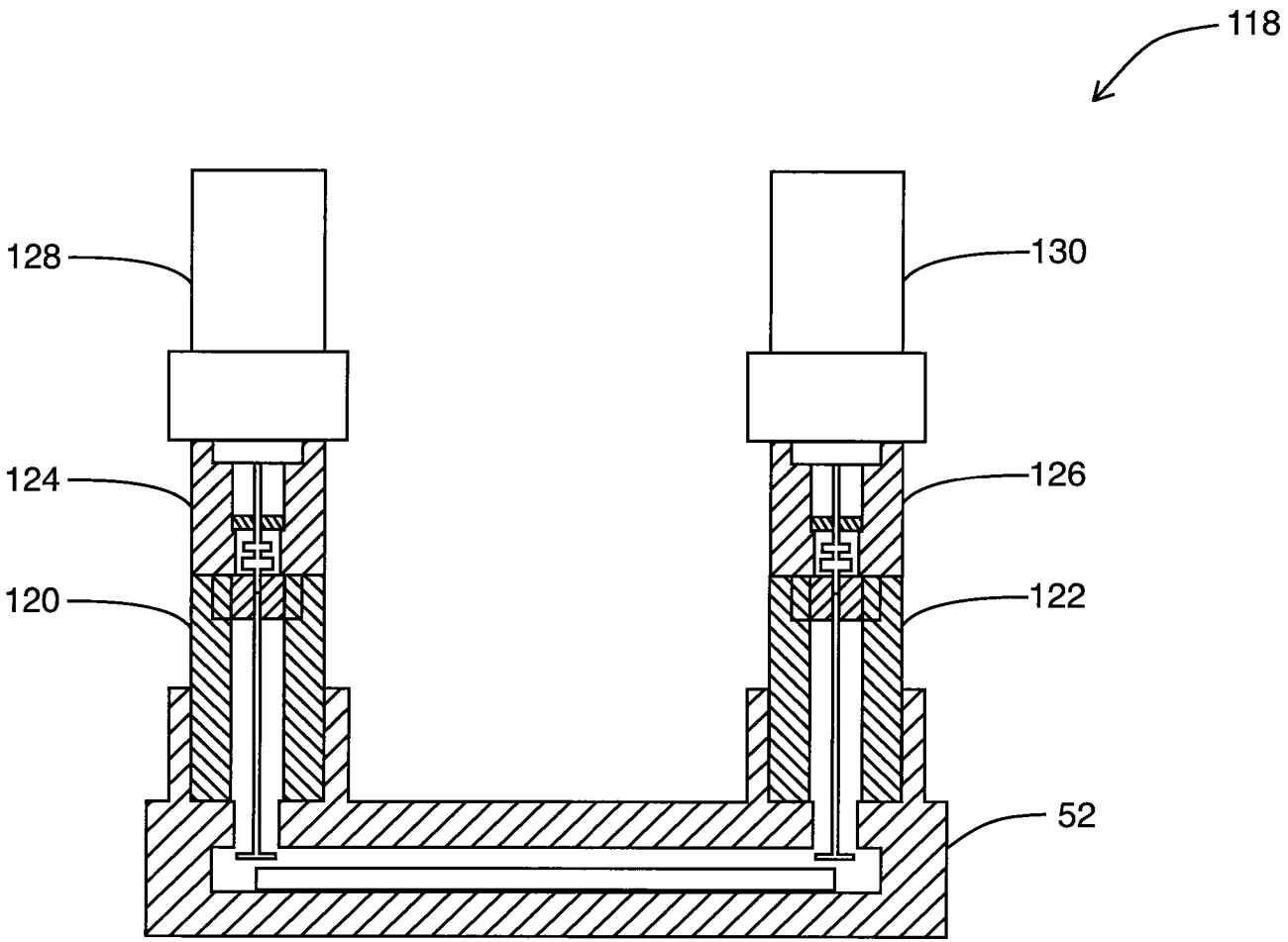
FIG. 6 is another exemplary embodiment of a configurable high frequency coaxial switch.

Reference is now made to FIG. 6, which shows a second embodiment of an exemplary configurable high frequency switch 118. The configurable high frequency switch 118 comprises a switch housing module 52, which is modular in nature as described previously, a first connector 120, and a second connector 122, which are standard connectors as known in the art, and may be of the same type as the first connector 32 and second connector 34 shown in FIGS. 1A and 1B. The configurable frequency switch 118 further comprises a first frequency-matching connector adapter module 124 and a second frequency-matching connector adapter module 126, which engage with the first connector 120 and the second connector 122, respectively, and which receive a first transmission line 128 and a second transmission line 130, respectively.

Each of the first frequency-matching connector adapter module 124 and the second frequency-matching connector adapter module 126 is designed so that the configurable high frequency switch 118 is operable in a narrow high-frequency band surrounding a desired operating frequency. If a different operating frequency is required, a different first frequency-matching connector adapter module 124 and second frequency-matching connector adapter module 126 can be used that can provide a match to the different narrow high frequency band surrounding the different operating frequency.

Figure 7:
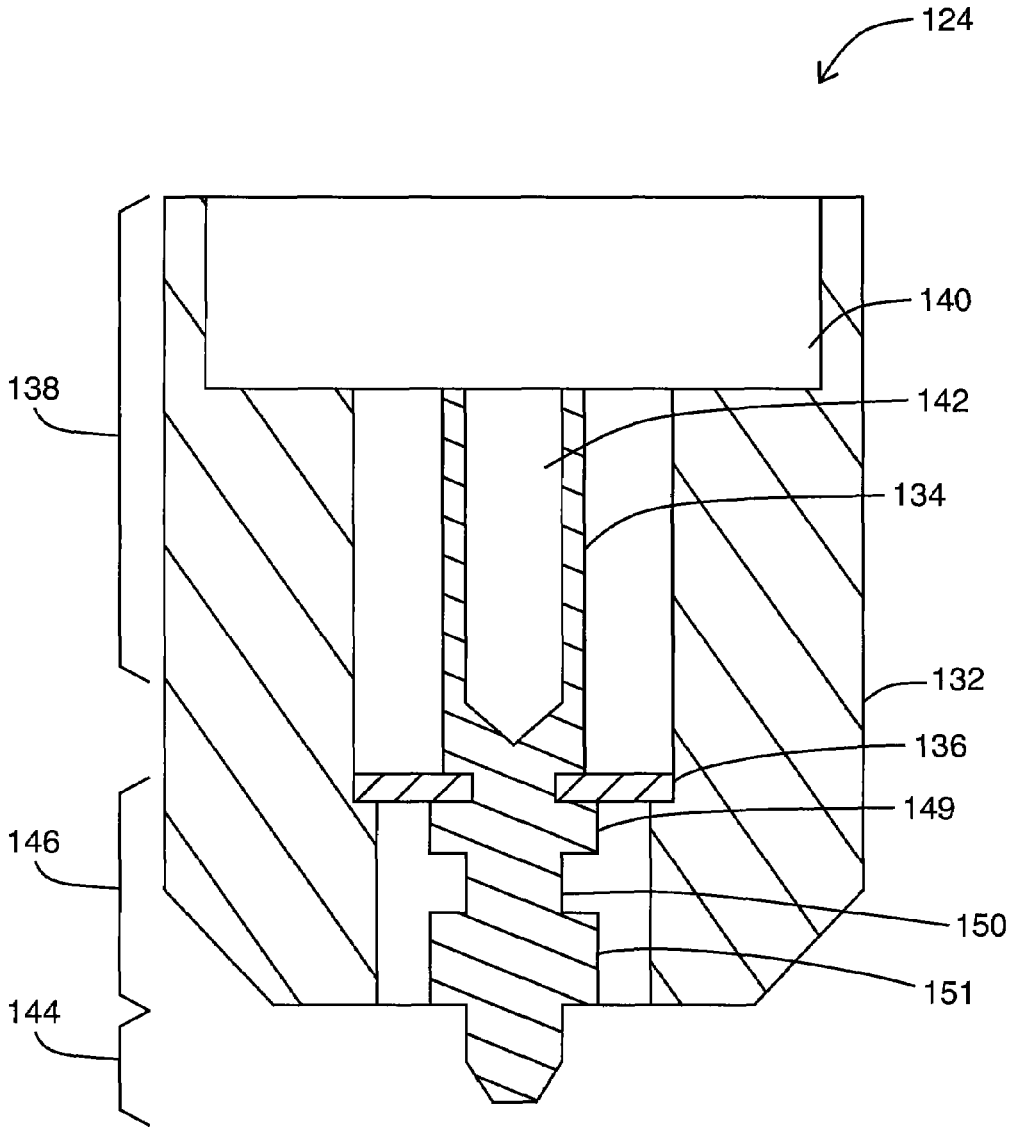
FIG. 7 is a cross-sectional view of a frequency-matching connector adapter module of the configurable high frequency coaxial switch of FIG. 6.

Reference is now made to FIG. 7, which shows a cross-section of an exemplary frequency-matching connector adapter module 124. The frequency-matching connector adapter module 124 comprises a hollow, cylindrical, open-ended adapter shell 132 and an adapter core module 134. The adapter shell 132 surrounds, but does not contact, the adapter core module 134. The adapter shell 132 and the adapter core module 134 are held in spaced configuration by one or more plastic beads 136, as is well known in the art.

The frequency-matching connector adapter module 124 further comprises a female portion 138 for receiving a transmission line (not shown). The female portion 138 comprises receiving sections 140, 142 in the adapter shell 132 and in the adapter core module 134 respectively, as is well known in the art. The frequency-matching connector adapter module 124 also comprises a male portion 144 for engaging a standard connector (not shown). At the male portion 144, the adapter core module 134 protrudes from the adapter shell 132 in order to engage the standard connector, as is well known in the art.

The frequency-matching connector adapter module 124 further comprises a frequency-matching portion 146. The frequency-matching portion 146 is characterized by at least one section 149, 150, 151 of the adapter core module 134 having a diameter differing from the diameter of the remainder of the adapter core 134. The dimensions and number of sections of the frequency-matching portion 146 are designed to match the configurable high frequency switch 118 to a narrow high-frequency band surrounding a desired operating frequency or desired frequency range.

Figure 8A:
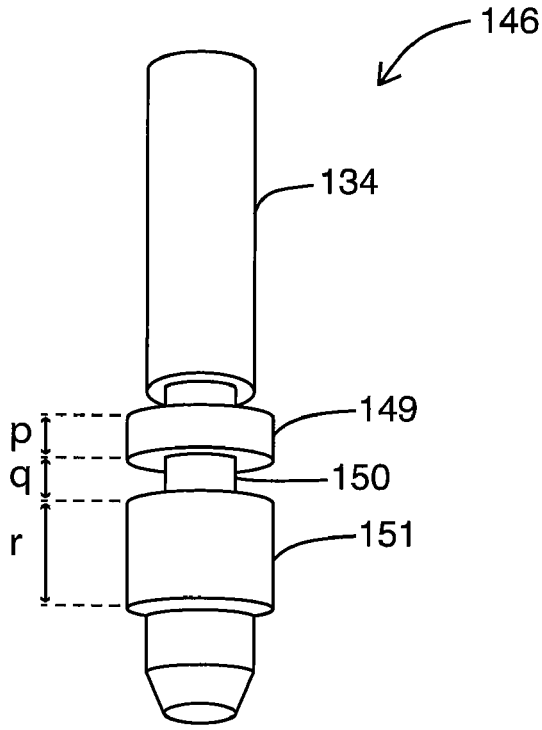
FIG. 8A is a perspective view of an exemplary frequency-matching portion of an adapter core for the frequency-matching connector module of FIG. 7.
Figure 8B:
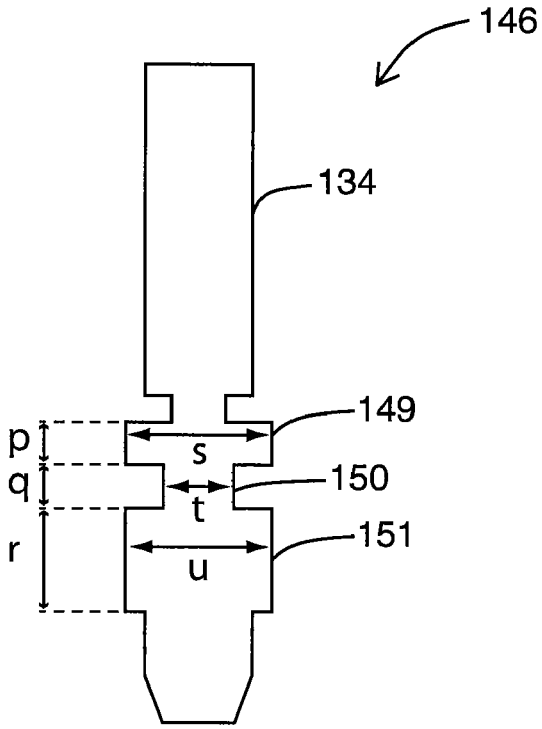
FIG. 8B is a cross-sectional view of an exemplary frequency-matching portion of an adapter core for the frequency-matching connector module of FIG. 7.

Reference is now made to FIGS. 8A and 8B, which show a perspective view, and a cross-sectional view, respectively, of an exemplary frequency-matching portion 146 of an adapter core module 134 for a frequency-matching connector adapter module as shown in FIG. 7. The frequency-matching portion 146 is characterized by a first section 149 of the adapter core module 134, a second section 150 of the adapter core module 134, and a third section 151 of the adapter core module 134, of lengths p, q, and r, respectively, and having diameters s, t and u, respectively. The number, lengths, p, q and r, and the diameters, s, t and u, of the sections 149, 150, 151 of the adapter core module 134 are designed such that the addition of the frequency-matching connector adapter module 124 between a transmission line and the standard connector 32 will reduce reflection in a narrow high frequency band surrounding an operating frequency of the configurable high frequency coaxial switch 118. The dimensions may be determined by any method known in the art It will be understood by those skilled in the art that a variety of similar frequency-matching adapter cores, having different numbers, diameters and lengths of sections are comprised in various embodiments of the frequency-matching adapter core module. The dimensions and shape of each frequency-matching adapter core module are selected to optimize the performance of the configurable high frequency coaxial switch 118 in a desired limited bandwidth or frequency range around the required operating frequency.

All of the other considerations regarding the way to achieve impedance matching, the type of ports and their influence on the geometry of the frequency-matching adapter module remain the same as in the first embodiment shown in FIGS. 3 to 5, except that only the frequency-matching connector adapter modules are changed when changing operation from one frequency range to another.

Figure 9:
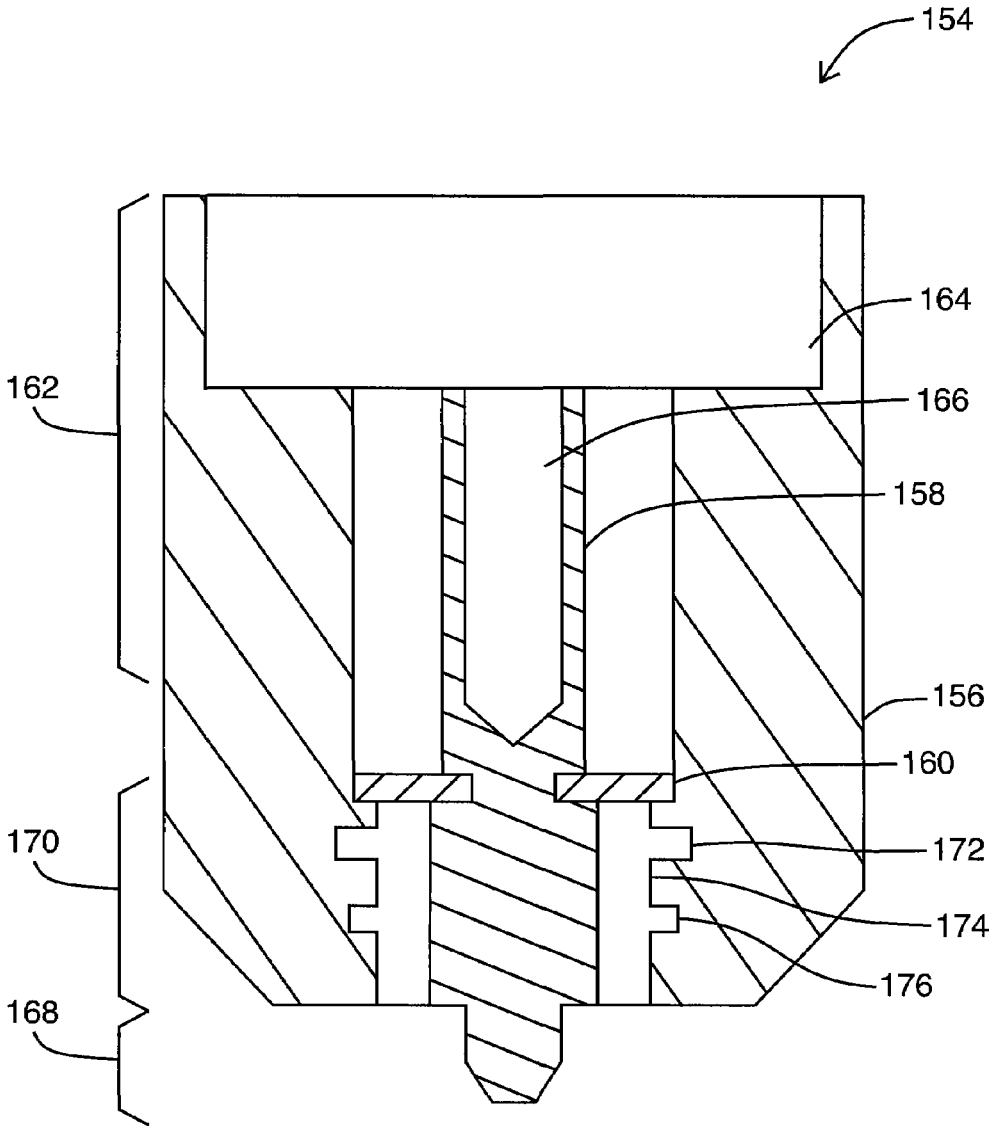
FIG. 9 is a cross-sectional view of another exemplary embodiment of a frequency-matching connector adapter module of the configurable high frequency coaxial switch of FIG. 6.

Reference is now made to FIG. 9, which shows another embodiment of a frequency-matching connector adapter module 154. The frequency-matching connector adapter module 154 comprises a hollow, cylindrical, open-ended adapter shell module 156 and an adapter core 158. The adapter shell module 156 surrounds, but does not contact, the adapter core 158. The adapter shell module 156 and the adapter core 158 are held in spaced configuration by one or more plastic beads 160, as is well known in the art.

The frequency-matching connector adapter module 154 further comprises a female portion 162 for receiving a transmission line (not shown). The female portion 162 comprises receiving sections 164, 166 in the adapter shell module 156 and in the adapter core 158 respectively, as is well known in the art. The frequency-matching connector adapter module 154 also comprises a male portion 168 for engaging a standard connector (not shown). At the male portion 168, the adapter core 158 protrudes from the adapter shell module 156 in order to engage the standard connector, as is well known in the art.

The frequency-matching connector adapter module 154 further comprises a frequency-matching portion 170. The frequency-matching portion 170 is characterized by at least one section 172, 174, 176 of the adapter shell module 156 having an inner diameter differing from the inner diameter of the remainder of the adapter shell module 156. The number, diameters and lengths of the sections are designed such that the configurable high frequency switch 118 is matched to a narrow high-frequency band surrounding a desired operating frequency (i.e. a desired frequency range). The dimensions may be determined by any method known in the art.

It will be understood by those skilled in the art that a variety of similar frequency-matching adapters, having different numbers, diameters and lengths of sections can be used in various embodiments of the frequency-matching adapter core and adapter shell modules. The dimensions and shape of each frequency-matching adapter core and adapter shell module are selected to optimize the performance of the configurable high frequency coaxial switch 118 in a desired limited bandwidth around the required operating frequency.

Figure 10A:
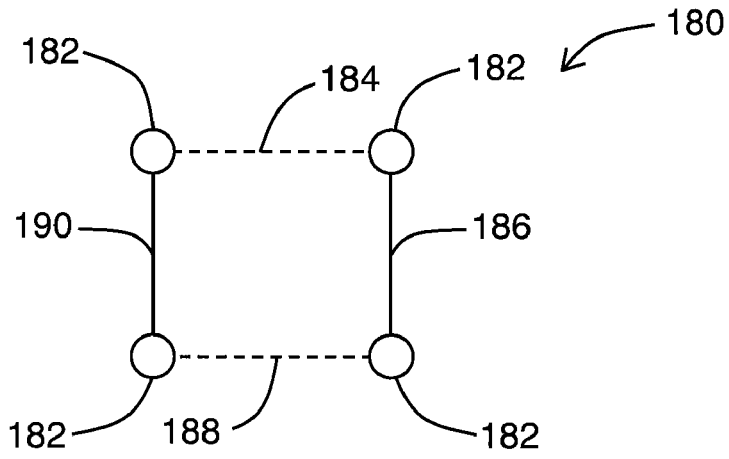
FIG. 10A is a schematic diagram of an exemplary configurable high frequency coaxial transfer switch.
Figure 10B:
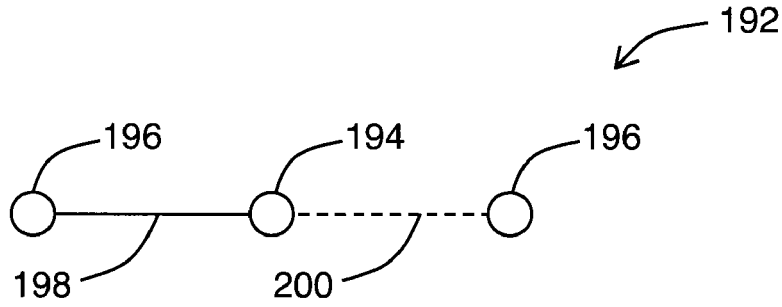
FIG. 10B is a schematic diagram of an exemplary configurable high frequency coaxial single pole double throw switch.
Figure 10C:
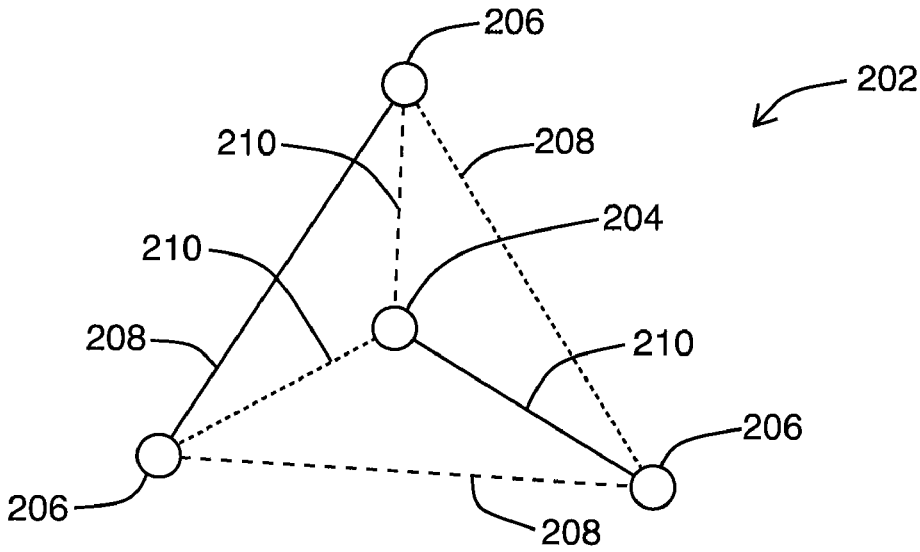
FIG. 10C is a schematic diagram of an exemplary configurable high frequency coaxial cross-point switch (T-switch)

Reference is now made to FIGS. 10A to 10C, which are schematic diagrams of three exemplary configurable high frequency coaxial switch types. Each configurable high frequency coaxial switch type comprises a number of ports for receiving transmission lines, and a number of switch paths connecting the ports. The geometric configuration of a port is determined by the number and geometry of the switch paths that terminate at that port. In many cases, the ports of a given configurable high frequency coaxial switch 50 have differing geometries. The geometry of the port dictates the geometry required in a frequency-matching port component module 54, in the form of either a frequency-matching connector module 58 or in the form of a frequency-matching connector adapter module 124 used in conjunction with a standard connector. As a result, in a single configurable high frequency coaxial switch, frequency-matching port component modules 54 having different geometries may be required at different ports.

FIG. 10A shows a schematic diagram of an exemplary configurable high frequency coaxial transfer switch 180, also known as a C-switch. The transfer switch 180 comprises four geometrically identical ports 182 in a four-square configuration, connected by four paths 184, 186, 188, 190, forming the perimeter of the square. Since the ports 182 are mutually geometrically identical, the four frequency-matching port component modules 54 required, for a configurable high frequency coaxial transfer switch 180, corresponding to a given limited high frequency range are identical for each port 182.

Reference is now made to FIG. 10B, which shows an exemplary configurable high frequency coaxial single pole double throw switch 192, comprising a central input port 194, two geometrically identical peripheral output ports 196 and two identical switch paths 198, 200, which connect the input port to each of the output ports 196. Since the peripheral output ports 196 are mutually geometrically identical, the two frequency-matching port component modules 54, 56 that are required to optimize a desired limited high frequency range are identical for each of the peripheral output ports 196. On the other hand, the geometry of the input port 194 is different from the geometry of the peripheral output ports 196, so the frequency-matching port component module 54 that is required to optimize to the same desired limited high frequency range as the peripheral output ports 196 may be different from the frequency-matching port component modules 54, 56 at the peripheral outer ports 196. Since the geometric shape of the input port 194 is different from the geometric shape of the peripheral ports 196, the shape of frequency-matching component module that is required to match the input port 194 to a desired frequency can have a different shape from the frequency-matching component modules 54, 56 that are required to match the peripheral ports 196 to the desired high frequency range.

Reference is now made to FIG. 10C, which shows an exemplary cross-point switch 202, also known as a T-switch. The cross-point switch comprises a central port 204 and three geometrically identical peripheral ports 206. The cross-point switch further comprises six switch paths 208, 210, three of which are outer switch paths 208 connecting the three peripheral ports, and three of which are spoke switch paths 210 connecting the central port 204 to each of the peripheral ports 206. Since the peripheral ports 206 are mutually geometrically identical, the three frequency-matching port component modules 54 for the peripheral ports 206 that are required to optimize a given desired limited high frequency range are identical for each of the peripheral ports 206. On the other hand, the geometry of the central port 204 is different from the geometry of the peripheral ports 206, so the frequency-matching port component module 56 for the central port 204 that is required to optimize the desired limited high frequency range is different from the frequency-matching port component modules 54 used at the peripheral ports 206.

In summary, looking to the various switch structures presented in FIGS. 10A, 10B and 10C, it can be noticed that the frequency matching port component modules corresponding to the ports 206, 196 or 182 have to be identical (for example the type described in FIGS. 4A and 4B) while the frequency matching port component modules corresponding to ports such as 204 may be different to accommodate the difference between the transmission paths such as 210 and 208. Similar considerations apply for any other structures of coaxial switches not depicted in FIGS. 10A, 10B and 10C.

A section from the frequency-matching port component modules described herein can be modeled as a transfer scattering matrix (Janusz A. Dobrowolski, Introduction to Computer Methods for Microwave Circuit Analysis and Design, Artech House Inc., ISBN 0-89006-505-5, 1991, pp. 30) as given by:

$$[T_i(g_i, \gamma_i, Z_i)] = \cosh(\gamma_i \cdot g_i) \cdot \begin{bmatrix} 1 + \frac{Z_N^2 + Z_i^2}{2 \cdot Z_N \cdot Z_i} \cdot \tanh(\gamma_i \cdot g_i) & \frac{Z_N^2 - Z_i^2}{2 \cdot Z_N \cdot Z_i} \cdot \tanh(\gamma_i \cdot g_i) \\ -\frac{Z_N^2 - Z_i^2}{2 \cdot Z_N \cdot Z_i} \cdot \tanh(\gamma_i \cdot g_i) & 1 + \frac{Z_N^2 + Z_i^2}{2 \cdot Z_N \cdot Z_i} \cdot \tanh(\gamma_i \cdot g_i) \end{bmatrix} \quad (2)$$

Where: $g_i$, $\gamma_i$, $Z_i$ are the section parameters: length, propagation constant and characteristic impedance respectively, $Z_N$ is the port reference impedance (50 Ω), and cosh and tanh are the hyperbolic cosine and hyperbolic tangent, respectively. Because the frequency-matching port component modules are cascaded sections of transmission lines with air (vacuum) as dielectric, the propagation constant $\gamma_i$, is given by:

$$\gamma_i = \alpha_{Ci} + j \cdot \beta_i \quad (3)$$

In equation (3), the attenuation constant $\alpha_{Ci}$ is due only to the properties of the inner and outer conductors, and is given by:

$$\alpha_{Ci} = 0.031471 \cdot \left(\frac{f \cdot \mu_0}{\pi}\right)^{1/2} \cdot \left(\frac{\rho_D^{1/2}}{D_i} + \frac{\rho_s^{1/2}}{s_i}\right) \cdot \frac{1}{\log\left(\frac{D_i}{s_i}\right)} \text{ dB/length} \quad (4)$$

In equation (4), f=frequency, $D_i$=inner diameter of the outer conductor, $s_i$=outer diameter of the inner conductor, $\rho_{D/s}$=electric resistivity of the outer conductor and inner conductor respectively, $\mu_0$=vacuum permeability ($4 \cdot \pi \cdot 10^{-7}$ H/m), the phase constant is:

$$\beta_i = \frac{2 \cdot \pi}{\lambda} \quad (5)$$

where λ=wavelength of the signal, and the characteristic impedance is:

$$Z_i = 138 \cdot \log\left(\frac{D_i}{s_i}\right) \Omega. \quad (6)$$

For the whole frequency-matching port component 54 the transfer scattering matrix is therefore:

$$[T_{FMP}(n, g_i, D_i s_i)] = \prod_{i=1}^{n} [T_i] \quad (7)$$

where n=number of sections in the frequency-matching port component module and $g_i$, $D_i$ and $s_i$ are the length and diameters of each section.

Figure 11:
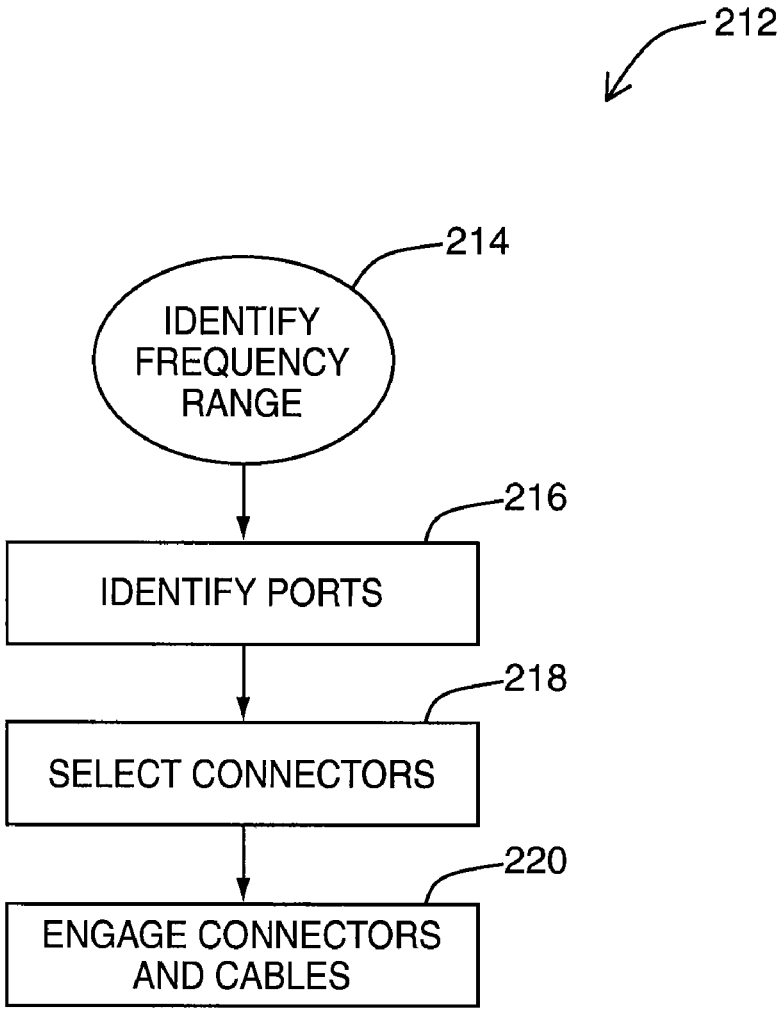
FIG. 11 is a schematic diagram illustrating an exemplary embodiment of a method of manufacturing a configurable high frequency coaxial switch.

Reference is now made to FIG. 11, which is a flow chart diagram illustrating an exemplary embodiment of a method 212 of manufacturing an exemplary configurable high frequency coaxial switch for use in a desired frequency range.

At a first step 214 of the method 212, the manufacturer of the configurable high frequency coaxial switch 50 identifies the limited high frequency range for which the performance of the configurable high frequency coaxial switch must be optimized in the desired application.

At a second step 216, the manufacturer of the configurable high frequency coaxial switch 50 identifies the geometrically identical and geometrically different ports 26 in the configurable high frequency coaxial switch 50. This can be done experimentally using a Vector Network Analyzer and measuring the scattering parameters for a required frequency range.

At the second step 216, if the replaceable frequency-matching port component modules 54 are frequency-matching connector modules 58, then it is necessary to de-embed the frequency-matching connector modules 58 from the measurement results. Characterizing the frequency-matching connector modules 58 used in the measurement can be done either by measurement or by modeling them as cascaded coaxial sections.

At the second step 216, if the frequency-matching port component modules 54 are frequency-matching connector adapters 124, the de-embedding step is not necessary because the scattering parameters fully characterize the RF path. In both cases the scattering parameters matrix has to be transformed to its transfer scattering form which is more useful for cascaded sections. The following formula can be used to achieve this:

$$[S] = \begin{bmatrix} S_{11} & S_{12} \\ S_{21} & S_{22} \end{bmatrix} \Rightarrow [T] = \begin{bmatrix} \frac{-S_{11} \cdot S_{22} + S_{12} \cdot S_{21}}{S_{21}} & \frac{S_{11}}{S_{21}} \\ -\frac{S_{22}}{S_{21}} & \frac{1}{S_{21}} \end{bmatrix} \quad (8)$$

where [S] is the scattering parameters matrix measured for each frequency point and the transfer scattering matrix [T] has its parameters defined in terms of wave variables normalized to the reference impedances of each port (i.e. 50 Ω).

Next, at a third step 218, the user selects the appropriate replaceable frequency-matching port component modules 54, in the form of either a frequency-matching connector module 58 or in the form of a frequency-matching connector adapter module 124 used in conjunction with a standard connector, for each port 26 of the configurable high frequency coaxial switch 50. The geometry of the frequency-matching port component modules 54 is related to the desired limited high frequency range, and the geometry of the port 26. The overall transfer scattering matrix of the switch housing module and the frequency-matching port component modules is the product of the corresponding transfer scattering matrices. This can be converted to the scattering parameters matrix format as:

$$\begin{bmatrix} T_{11} & T_{12} \\ T_{21} & T_{22} \end{bmatrix} \Rightarrow \begin{bmatrix} \frac{T_{12}}{T_{22}} & T_{11} - \frac{T_{12} \cdot T_{21}}{T_{22}} \\ \frac{1}{T_{22}} & -\frac{T_{21}}{T_{22}} \end{bmatrix} \quad (9)$$

The optimization consists in finding the parameters n, $g_i$, $D_i$, $s_i$ such as to minimize $$\frac{T_{12}}{T_{22}} \text{ and } \frac{T_{21}}{T_{22}}$$

in the desired frequency range.

At a fourth step 220, the manufacturer installs the appropriate frequency-matching port component modules 54 with the ports 26, and engages the transmission lines 36 with the frequency-matching port component modules 54.

While certain features of the various embodiments have been illustrated and described herein, many modifications, substitutions, changes, and equivalents will now occur to those of ordinary skill in the art. It is, therefore, to be understood that the appended claims are intended to cover all such modifications and changes that fall within the scope of the embodiments described herein.

The invention claimed is:

1. A configurable high frequency coaxial switch, comprising:

a switch housing module having at least two ports, the switch housing module being adapted for operation in a wide frequency band; and, at least one frequency-matching port component module configured to connect a transmission line to one of the ports of the switch housing module, the at least one frequency-matching port component module further being configured to provide a match to a desired frequency range, wherein, in use, the switch housing module together with the at least one frequency-matching port component module allow for operation of the configurable high frequency coaxial switch at the desired frequency range.

2. The configurable high frequency coaxial switch of claim 1, wherein the at least one frequency-matching port component module is a frequency-matching connector module comprising:

a connector female portion for receiving the transmission line; and, a connector male portion, attached to the connector female portion, for engaging one of the ports of the switch housing module, wherein the connector male portion comprises a modular portion with a geometry configured to provide a match for the configurable high frequency coaxial switch to the desired frequency range.

3. The configurable high frequency coaxial switch of claim 2, wherein the connector male portion comprises:

a connector shell; and, a frequency-matching probe module with a frequency-matching region, which protrudes from the connector shell, the frequency-matching region comprising at least one section with a length and a diameter that is different from the length and diameter of the rest of the frequency-matching probe module to provide the match to the desired frequency range.

4. The configurable high frequency coaxial switch of claim 3, wherein the number of sections, and the length and diameter of each of the at least one section are configured to provide the match to the desired frequency range.

5. The configurable high frequency coaxial switch of claim 1, wherein the at least one frequency-matching port component module is a frequency-matching connector adapter module configured to engage a standard connector for one of the ports of the switch housing module, the frequency-matching connector adapter module comprising:

an adapter female portion for receiving the transmission line;

an adapter male portion for engaging the standard connector; and, an adapter frequency-matching portion for connecting the adapter female portion to the adapter male portion and having a geometry that is configured to provide a match for the configurable high frequency coaxial switch to the desired frequency range.

6. The configurable high frequency coaxial switch of claim 5, wherein the frequency-matching connector adapter module comprises:

an adapter shell; and, an adapter core module, wherein, in the adapter frequency-matching portion, the adapter core module comprises at least one section with a length and a diameter that is different from the length and diameter of the rest of the adapter core module to provide the match to the desired frequency range.

7. The configurable high frequency coaxial switch of claim 6, wherein the number of sections, and the length and diameter of each of the at least one sections are configured to provide the match to the desired frequency range.

8. The configurable high frequency coaxial switch of claim 5, wherein the frequency-matching connector adapter module further comprises:

(a) an adapter shell module; and, (b) an adapter core, wherein, in the adapter frequency-matching portion, the adapter shell module comprises at least one section with a length and an inner diameter that is different from the length and inner diameter of the rest of the adapter shell module to provide the match to the desired frequency range.

9. The configurable high frequency coaxial switch of claim 8, wherein the number of sections, and the length and inner diameter of each of the at least one sections are configured to provide the match to the desired frequency range.

10. The configurable high frequency coaxial switch of claim 1, further comprising a first port and a second port that is geometrically identical to the first port, and a first frequency-matching port component module and a second frequency-matching port component module that is geometrically identical to the first frequency-matching port component module.

11. The configurable high frequency coaxial switch of claim 1, further comprising a first port, and a second port that is geometrically different from the first port, and a first frequency-matching port component module and a second frequency-matching port component module that is geometrically different from the first removable frequency-matching port component module.

12. A frequency-matching connector module for use in a configurable high frequency coaxial switch adapted for operation in a wide frequency band, wherein the frequency-matching connector module comprises:

a connector female portion for receiving a transmission line; and, a connector male portion, attached to the connector female portion, for engaging a port of the configurable high frequency coaxial switch, wherein the connector male portion comprises a modular portion with a geometry configured to provide a match for the configurable high frequency coaxial switch to a desired frequency range.

13. The frequency-matching connector module of claim 12, wherein the connector male portion comprises:

a connector shell; and, a frequency-matching probe module with a frequency-matching region, which protrudes from the connector shell, the frequency-matching region comprising at least one section with a length and a diameter that is different from the length and diameter of the rest of the frequency-matching probe to provide the match to the desired frequency range.

14. The frequency-matching connector module of claim 13, wherein the number of sections, and the length and diameter of each of the at least one section are configured to provide the match to the desired frequency range.

15. A frequency-matching connector adapter module for use in a configurable high frequency coaxial switch adapted for operation in a wide frequency band, the frequency-matching connector adapter module comprising:

an adapter female portion for receiving a transmission line;

an adapter male portion for engaging a standard connector for a port of the reconfigurable high frequency coaxial switch; and, an adapter frequency-matching portion, for connecting the adapter female portion to the adapter male portion and having a geometry that is configured to provide a match for the configurable high frequency coaxial switch to a desired frequency range.

16. The frequency-matching connector adapter module of claim 15, further comprising:

(a) an adapter shell; and, (b) an adapter core module, wherein, in the adapter frequency-matching portion, the adapter core module comprises at least one section with a length and a diameter that is different from the length and diameter of the rest of the adapter core module to provide the match to the desired frequency range.

17. The frequency-matching connector module of claim 16, wherein the number of sections, and the length and diameter of each of the at least one section are configured to provide the match to the desired frequency range.

18. The frequency-matching connector adapter module of claim 15, further comprising:

an adapter shell module; and, an adapter core, wherein, in the adapter frequency-matching portion, the adapter shell module comprises at least one section with a length and an inner diameter that is different from the length and inner diameter of the rest of the adapter shell module to provide the match to the desired frequency range.

19. The frequency-matching connector module of claim 16, wherein the number of sections, and the length and inner diameter of each of the at least one section are configured to provide the match to the desired frequency range.

* * * * *